US006389606B1

(12) United States Patent
Galet et al.

(10) Patent No.: US 6,389,606 B1
(45) Date of Patent: May 21, 2002

(54) PROTECTIVE HELMET WITH AN ANCHORING DEVICE FOR A RESPIRATORY MASK

(75) Inventors: Adrien Galet; Louis Guay, both of Chatillon sur Chalaronne (FR)

(73) Assignee: Gallet S.A., Chatillon Sur Chalaronne (FR)

( * ) Notice: Subject to any disclaimer, the term of this patent is extended or adjusted under 35 U.S.C. 154(b) by 0 days.

(21) Appl. No.: 09/420,811

(22) Filed: Oct. 19, 1999

(30) Foreign Application Priority Data

Oct. 20, 1998 (FR) ..... 98 13340

(51) Int. Cl.[7] ..... A42B 1/06
(52) U.S. Cl. ..... 2/410; 2/422; 2/424
(58) Field of Search ..... 2/410, 422, 6.2, 2/417, 173, 424; 128/201.24, 202.27

(56) References Cited

U.S. PATENT DOCUMENTS 2,867,812 A * 1/1959 Roth et al. ..... 2/6.2
3,065,747 A * 11/1962 Forkel
4,734,940 A * 4/1988 Galet et al. ..... 2/422
4,869,245 A * 9/1989 Nowakowski et al. ..... 2/422 X
5,003,632 A * 4/1991 Claude

FOREIGN PATENT DOCUMENTS

| | | | | |
|---|---|---|---|---|
| EP | 0105813 | | 3/1986 | |
| FR | 2707141 | * | 1/1995 | ..... 2/422 |
| GB | 2126076 | * | 3/1984 | ..... 2/6.2 |

* cited by examiner

*Primary Examiner*—Rodney M. Lindsey
(74) *Attorney, Agent, or Firm*—Greenblum & Bernstein, P.L.C.

(57) ABSTRACT

A protective helmet of the type that includes a device for attaching a respiratory mask. This arrangement includes an arrangement for adjusting the position of the attachment device, enabling the positioning thereof in at least two positions and the attachment device is in one piece with an attachment part adjustably affixed to the shell of the helmet to enable modifying the position thereof.

33 Claims, 8 Drawing Sheets

PROTECTIVE HELMET WITH AN ANCHORING DEVICE FOR A RESPIRATORY MASK

BACKGROUND OF THE INVENTION

1. Field of the Invention

The present invention relates to a protective helmet, and more particularly to a protective helmet having a device for attaching a respiratory mask.

2. Description of Background and Relevant Information

Protective helmets have long been used in various fields, including professional fields such as the case for military personnel, police officers, or firefighters, and civilian or private fields.

For example, European Patent Publication 0 105 813 discloses a helmet which can be used with a breathing, or respiratory, mask of the type according to which the latter is held on the shell of the helmet by two lateral arms comprising hooks on their ends, adapted to removably engage with two attachment notches made in the side walls of the helmet. This type of arrangement is particularly practical and currently used by numerous firefighters. However, despite the telescopic effect of the lateral arms, adapted to give the mask pressure on the face which is both secure and comfortable, it happens that in certain cases the automatic adaptation is faulty.

SUMMARY OF THE INVENTION

An object of the invention, therefore, is to overcome the aforementioned drawback by enabling adaptation of the position of the respiratory mask, on the one hand, to the dimensions of the helmet, and especially to the dimensions of the shell and/or the adjustments of the internal elements, such as the band and the lining, and, on the other hand, to the dimensions of the head, and especially to the face of the user. To this end, the helmet of the invention comprises an arrangement for adjusting the position of the device for attaching the mask.

Thus, the protective helmet of the invention is of the type comprising a device for attaching a respiratory mask, wherein it includes an arrangement for adjusting the position of the attachment device, enabling the positioning thereof in at least two positions.

According to an additional characteristic, the attachment device includes an attachment notch or an attachment protrusion made in one piece with the helmet, while, according to a preferred embodiment, the attachment notch or the attachment protrusion is made in one piece with an attachment part adjustably affixed to the shell of the helmet to enable modification of the position thereof.

Additionally, the protective helmet of the invention comprises an external shell comprising two side walls corresponding to the zones occupied by the ears of the user with the understanding that each of these side walls comprises an attachment part.

Moreover, the adjustment arrangement may be continuous or discontinuous to enable either fine adjustment or step-by-step adjustment at two, or even more, for example, three, successive positions.

According to a preferred embodiment, the adjustment arrangement includes a succession of protrusions formed in one piece with the shell and cooperating with a succession of recessed sections obtained in the attachment part or conversely, while a locking mechanism is provided to lock the attachment part in the position selected, once this has been determined.

According to another embodiment, at least one of the attachment parts is affixed to the shell of the helmet by an intermediate part and, according to a preferred embodiment, this intermediate part includes of an open stirrup, which is open toward the front to be affixed to the outside of the shell.

BRIEF DESCRIPTION OF DRAWINGS

Other characteristics and advantages of the invention will become apparent from the following description, with reference to the annexed drawings which are only provided as non-limiting examples:

FIG. 4 is an external side view;

FIG. 5 is a longitudinal cross-sectional view along the line A—A;

FIG. 6 is a cross-sectional view along the line B—B;

FIG. 7 is a bottom view;

FIG. 8 is a side view;

FIG. 9 is a top view;

FIG. 9*a* is an end view;

FIG. 8*a* depicts a variant embodiment;

FIG. 14 is a perspective view; and

FIG. 15 is a side view.

DETAILED DESCRIPTION OF THE INVENTION

Figure 1:
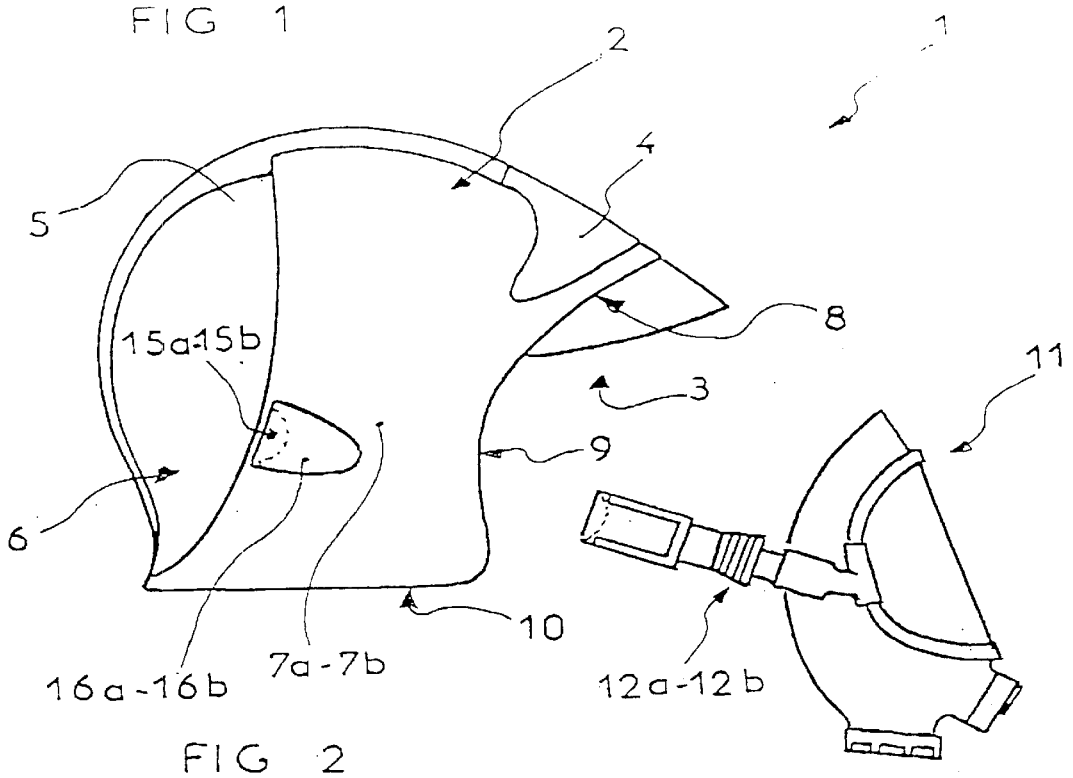
FIG. 1 is a side view depicting the helmet of the invention and the respiratory mask adapted to be attached thereto.
Figure 2:
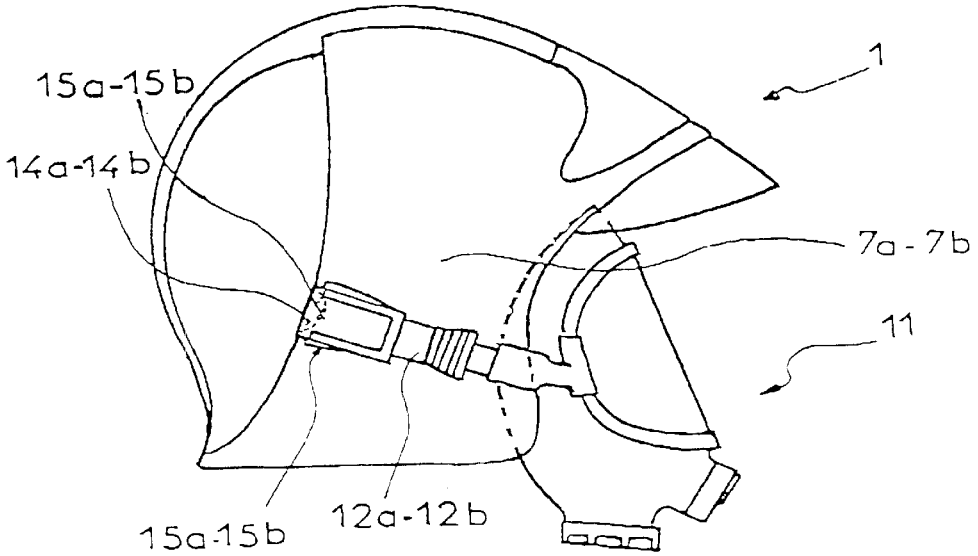
FIG. 2 is a side view of this same helmet with respiratory mask.
Figure 3:
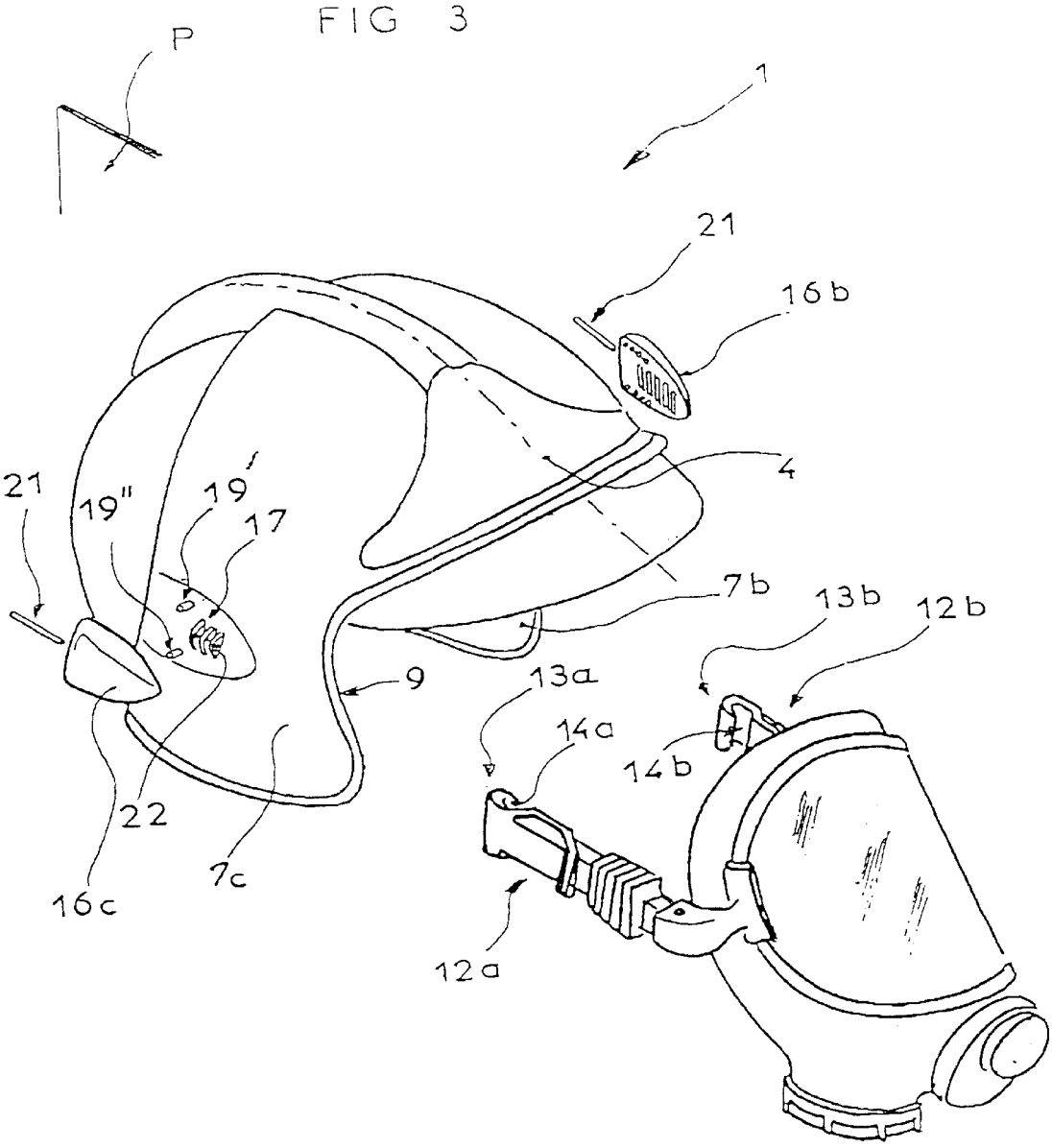
FIG. 3 is a perspective view similar to FIG. 1.
Figure 4:
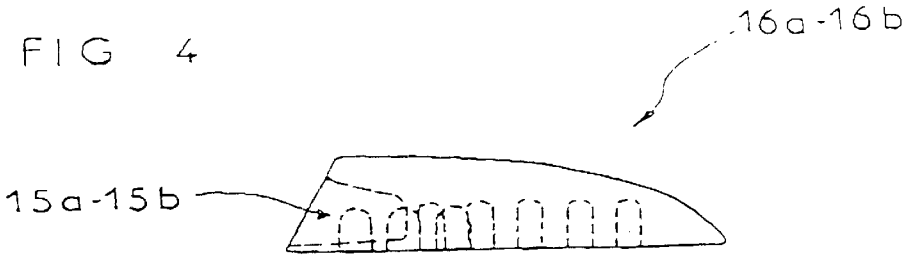
FIGS. 4, 5, 6, and 7 are views depicting the adjustable attachment part, whereby.
Figure 5:
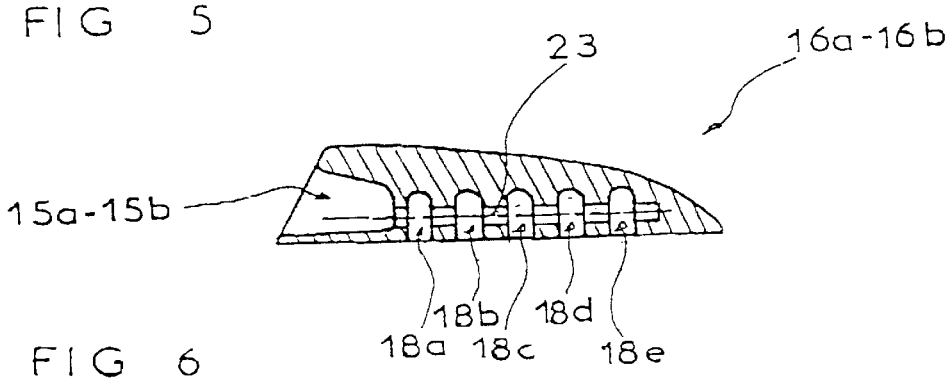
Figure 6:
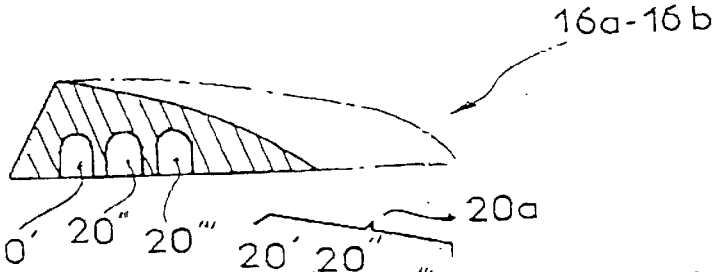
Figure 7:
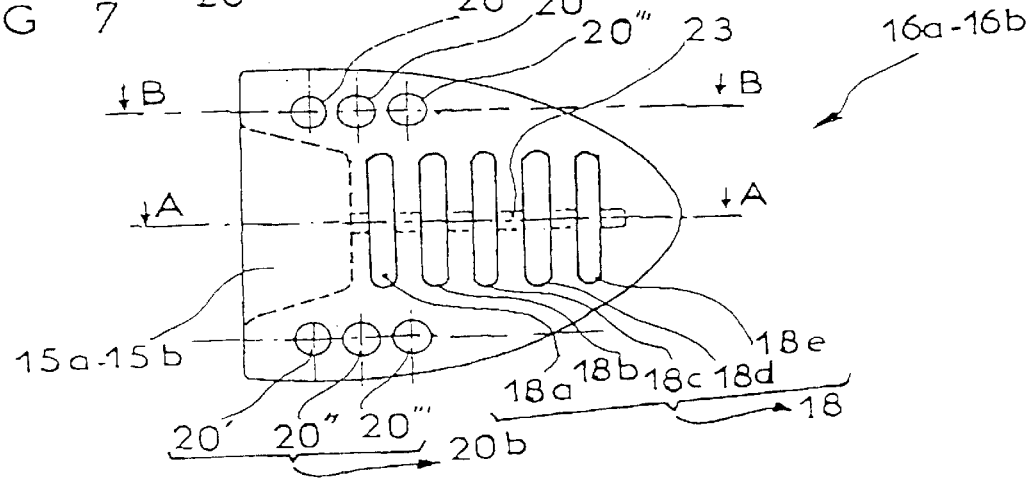
Figure 9A:
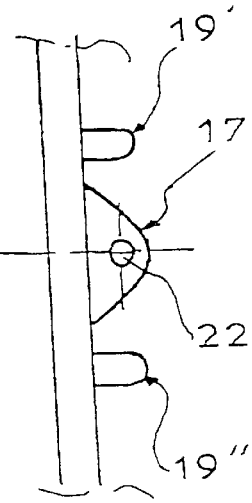
Figure 9:
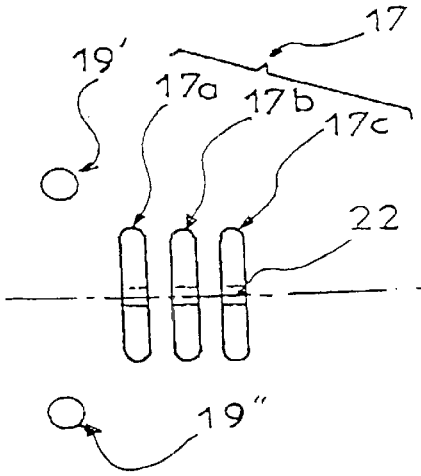

The protective helmet 1 equipped with the attachment device for a respiratory mask according to the invention may be of any type, for example, of the type used by firefighters and which comprises a primary outside shell 2 protecting the cranium and the nape of the neck of the user, and having a front face opening 3 in the zone occupied by the face itself of the user, the helmet having a vertical longitudinal plane P of general symmetry.

The shell is made of rigid material and can be made of any appropriate material such as plastic, steel, aluminum, or a composite material of the type comprising a stack of reinforcement fiber layers, impregnated and interconnected together by a resin matrix. The external shell consists of a substantially spherical wall comprising a plurality of wall portions, namely, a front top wall portion 4, extended toward the rear by a rear top wall portion 5, itself extended toward the bottom by a rear bottom wall portion 6, and comprises, in addition, two side wall portions, a right side wall portion 7*a* and a left side wall portion 7*b*. The front top portion 4 corresponds to the zone occupied by the forehead of the user and is limited by the top edge 8 of the face opening 3 which, in turn, is limited laterally by two side edges 9. The rear top wall portion 5 corresponds to the zone occupied by the cranium of the user, while the rear bottom wall portion 6 corresponds to the zone occupied by the nape of the neck of the user. In addition, the wall of the shell is limited toward the bottom by a bottom edge 10. The side wall portions 7*a*, 7*b* correspond to the zones occupied by the ears of the user and are limited toward the front by the corresponding side edge 9 of the face opening 3 and toward the bottom by the front ends of the bottom edge 10.

The helmet 1 according to the invention enables its use in combination with a removable respiratory mask 11 of the type, for example, which comprises two lateral attachment arms 12*a*, 12*b* of which each of the free ends 13*a*, 13*b* comprises an attachment hook 14*a*, 14*b* adapted to engage with attachment notches 15*a*, 15*b*, formed by hollowed seats, arranged on the side walls 7*a*, 7*b* of the shell 2.

Thus, on each of its two side walls 7*a*, 7*b*, the shell of the helmet comprises an attachment device, such as an attachment notch, including a hollowed seat 15*a*, 15*b* made in an attachment part 16*a*, 16*b*.

According to a characteristic of the invention, each of the attachment parts 16*a*, 16*b* is affixed to the corresponding side wall 7*a*, 7*b* of the helmet so as to be able to adjust the position thereof. Thus, an adjustable affixing device is provided to affix the attachment parts on the shell. This device is a continuous adjustment device, enabling the precise positioning of the attachment parts or a discontinuous adjustment device enabling the positioning of the attachment parts in different successive positions, such as two, or even more, for example, three, according to the embodiment depicted.

The adjustment device may have any number of configurations, for example, a protrusion or a succession of protrusions 17 cooperating with a succession of corresponding recesses 18. According to the embodiment, the adjustment device for each of the attachment parts include a group of three successive central protrusions 17*a*, 17*b*, 17*c* and two lateral pins 19', 19" made on the side wall 7*a*, 7*b* of the shell, while the attachment part 16*a*, 16*b* comprises a succession of five central recessed sections 18*a*, 18*b*, 18*c*, 18*d*, 18*e* and two successions 20*a*, 20*b* of three lateral seats 20', 20", 20'".

The successive central protrusions 17 of the shell 2 are adapted to engage in the corresponding central recessed sections 18 of the attachment part, while the lateral pins 19', 19" are engaged in the corresponding lateral seats 20*a*, 20*b*.

The successive central protrusions 17*a*, 17*b*, 17*c*, 17*d*, 17*e* consist of successive parallel walls having the general shape of triangles while the lateral pins 19', 19" are cylindrical or conical. Likewise, the recessed sections 18*a*, 18*b*, 18*c*, 18*d*, 18*e* have a shape and dimensions complementary to the protrusions. Moreover, the lateral seats are cylindrical or conical to correspond to the pins which they accommodate.

Thus, the attachment part 16*a*, 16*b* may assume a plurality of positions, namely, in the exemplary embodiment, one of the three positions A, B, C.

The device comprises, of course, a locking mechanism enabling the locking of the attachment part 16*a*, 16*b* in the position selected. By way of example, the locking mechanism includes, as depicted, a movable longitudinal rod 21 engaged, on the one hand, in a hole 22 made in the protrusions 17 and, on the other hand, in a corresponding hole 23 made in the axis of the attachment parts 16*a*, 16*b*.

Figure 10A:
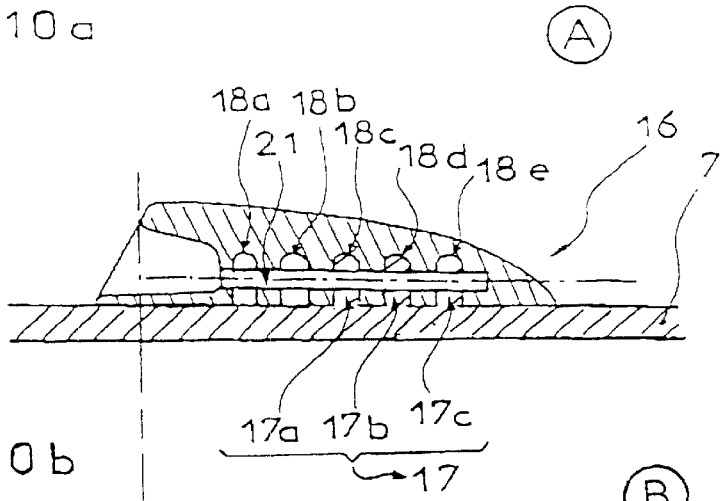
FIGS. 10*a*, 10*b*, and 10*c* are longitudinal cross-sectional views of the attachment part in its three different possible positions, with FIG. 10*a* depicting its rear position (A), FIG. 10*b* its intermediate position (B), and FIG. 10*c* its front position (C)
Figure 10B:
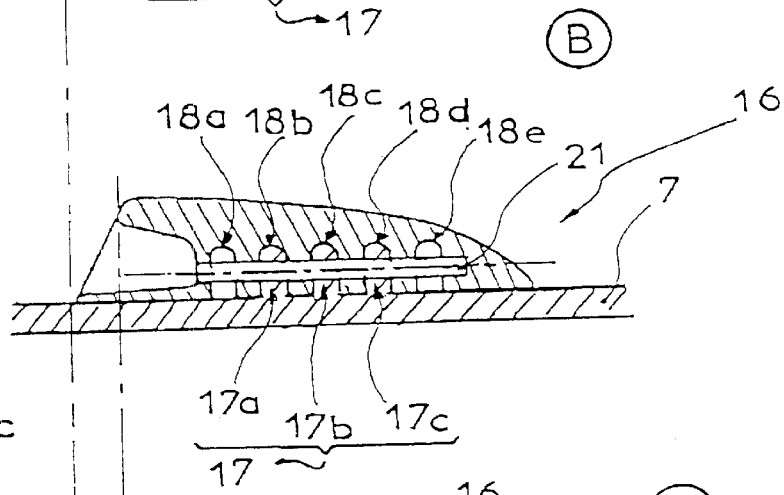
Figure 10C:
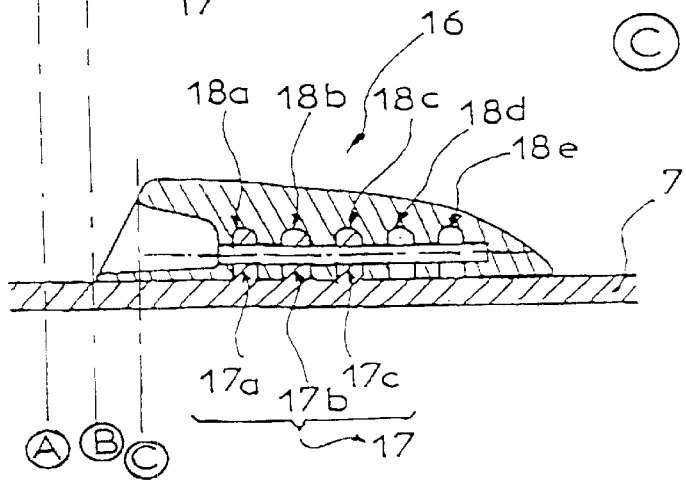
Figure 11A:
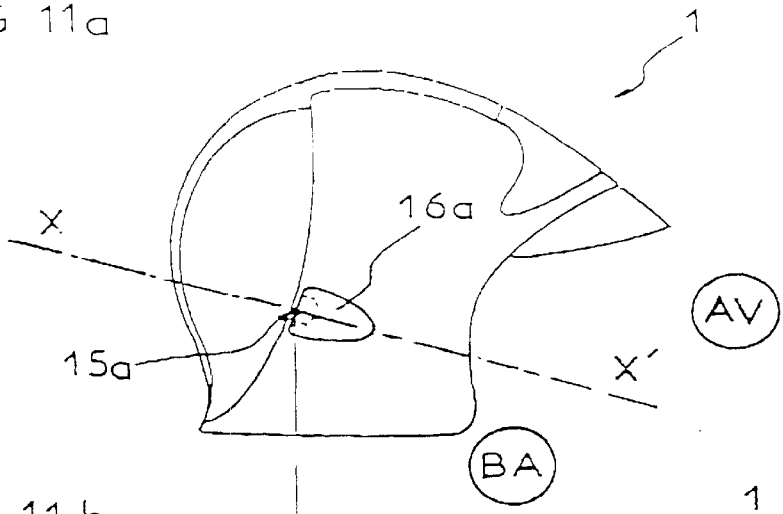
FIGS. 11*a*, 11*b*, and 11*c* depict the helmet with its attachment part in the three positions depicted in FIGS. 10*a*, 10*b*, and 10*c;*
Figure 11B:
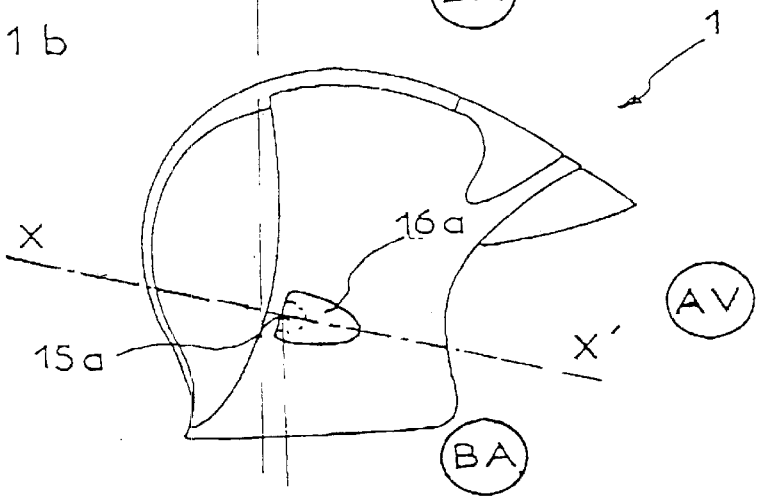
Figure 11C:
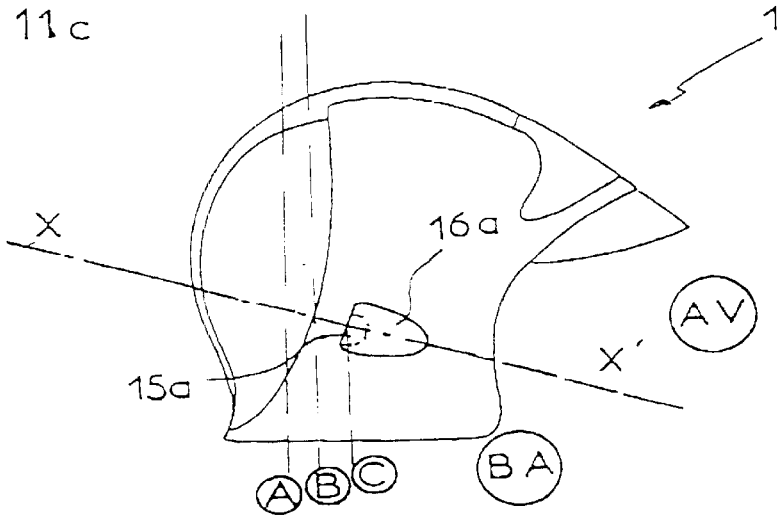

FIGS. 10*a*, 10*b*, 10*c*, 11*a*, 11*b*, 11*c* depict the attachment device according to three different positions: a rear position A depicted in FIGS. 10*a* and 11*a*, a front position C depicted in FIGS. 10*c* and 11*c*, and an intermediate position B depicted in FIGS. 10*b* and 11*b*.

The rear position A is obtained by engagement of three protrusions 17*a*, 17*b*, 17*c* in the three front recessed sections 18*c*, 18*d*, 18*e* of the attachment part.

The front position C is obtained by engagement of three protrusions 17*a*, 17*b*, 17*c* in the three back recessed sections 18*a*, 18*b*, 18*c* of the attachment part.

The intermediate position B is obtained by engagement of three protrusions 17*a*, 17*b*, 17*c* in the three central recessed sections 18*b*, 18*c*, 18*d* of the attachment part.

It is to be understood from reading this disclosure that the attachment notch(es) 15*a*, 15*b* constitute the device for attaching the respiratory mask 11 on the helmet 1. Advantageously, these attachment notches 15*a*, 15*b* are made in the attachment part 16*a*, 16*b* while the latter is advantageously adjustably affixed to the shell 2 of the helmet 1 so as to be able to modify the position thereof. The attachment part(s) 16*a*, 16*b* according to the embodiment of FIGS. 1 through 11*c* are affixed to the outside of the helmet 1 on the outside surface of the side walls 7*a*, 7*b* of the primary outside shell 2.

The attachment part 16*a*, 16*b* could obviously be affixed to the inside surface of the shell so as to be arranged inside the helmet (not shown) rather than outside, as is the case in the embodiment depicted in FIGS. 1 through 11*c*.

It would also be possible to provide any type of locking device for the attachment part 16*a*, 16*b* other than a rod 21, for example, a screw/bolt system or a cam system mounted on a lever.

Figure 13:
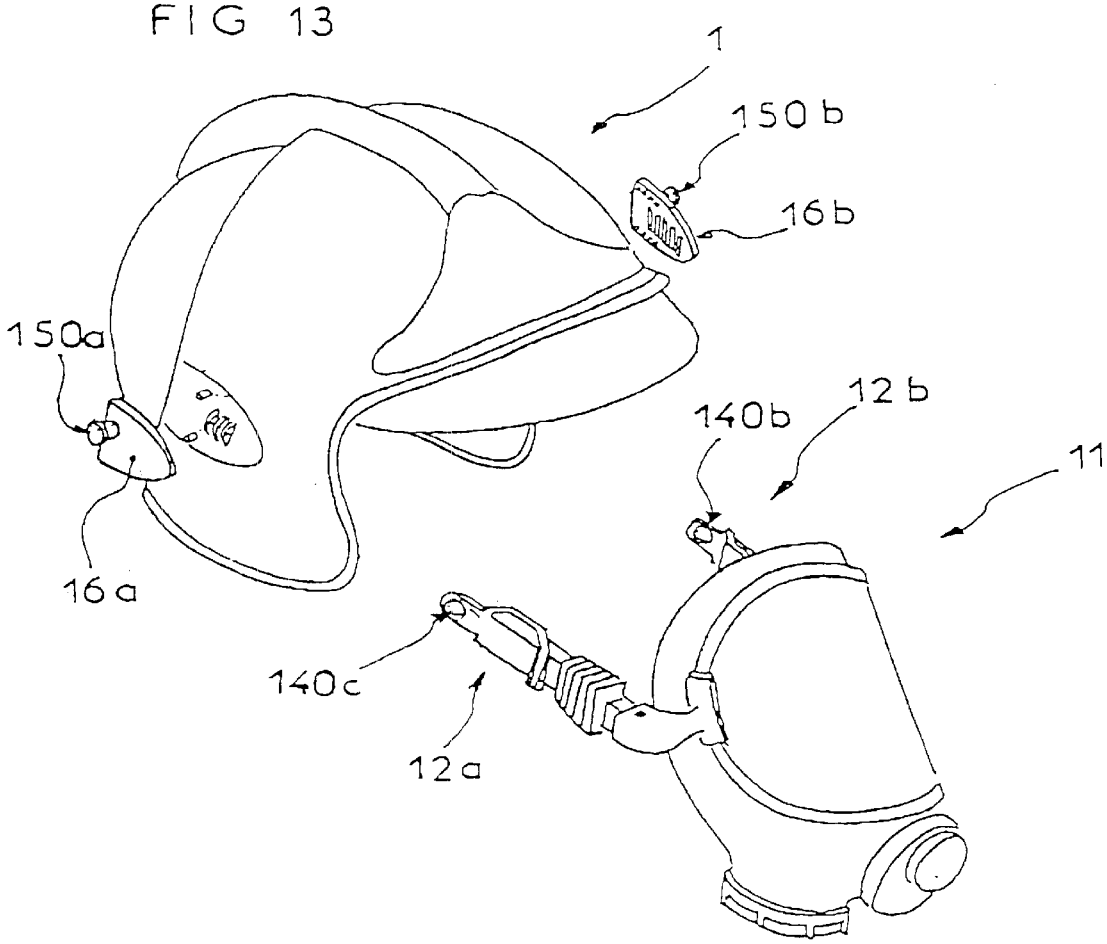
FIG. 13 is a cross-sectional view of the adjustment device according to a variant.

Also, the device for attaching the mask could obviously be of any other type, for example, that depicted in FIG. 13, where the attachment notches 15*a*, 15*b* are replaced by attachment protrusions 150*a*, 150*b*, while the hooks 14*a*, 14*b* are replaced by an attachment hole 140*a*, 140*b*.

Figure 12:
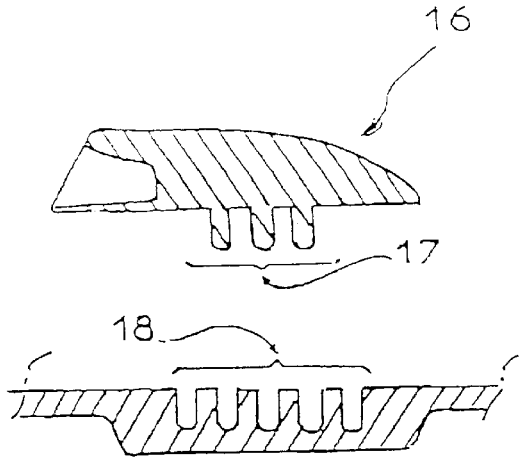
FIG. 12 is a perspective view depicting a variant embodiment.

It will be noted that according to the depictions of FIGS. 3 through 10, the protrusions 17 are made in one piece with the shell 2 and specifically with its side walls 7*a*, 7*b*, while the corresponding recessed sections 18 are made in the attachment part 16*a*, 16*b*, but this could be implemented otherwise, in particular, conversely. Thus, the protrusions 17 could be on the attachment part 16*a*, 16*b* while the recessed sections would be on the shell, as depicted in FIG. 12.

Figure 8:
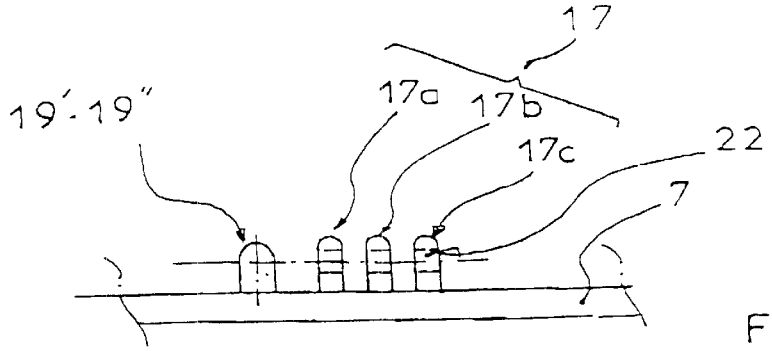
FIGS. 8, 8*a*, 9, and 9*a* are views depicting the additional adjustment arrangement associated with the helmet, whereby.
Figure 8A:
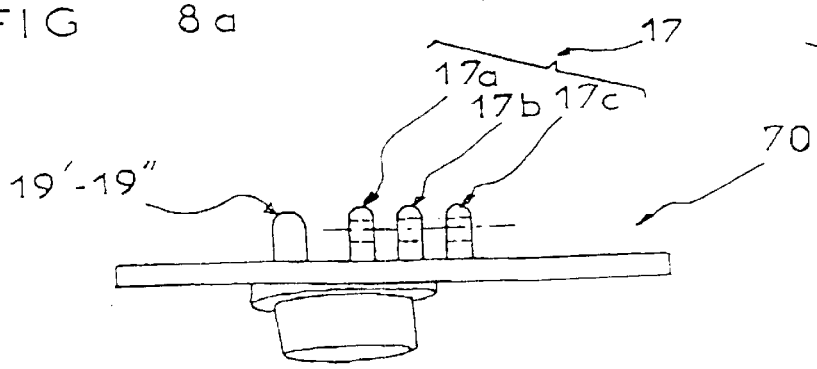

The protrusions 17 and pins 19 could be made in one piece with an intermediate part 70 as depicted in FIG. 8*a*, which would then be affixed on the wall of the shell.

At the time of position adjustment of the attachment parts 16*a*, 16*b*, these are moved along a trajectory XX' sloping downward (BA) and frontward (AV) to be substantially in alignment with the lateral arms of the mask.

Figure 14:
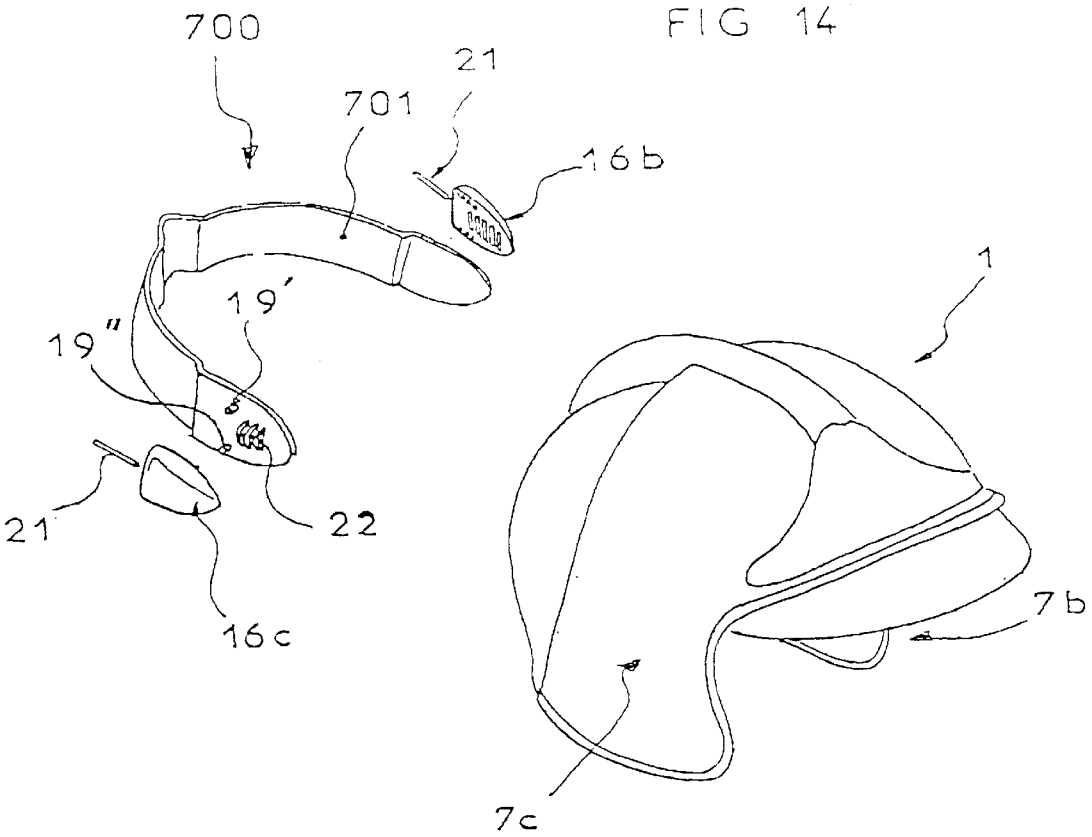
FIGS. 14 and 15 depict a variant embodiment, whereby.
Figure 15:
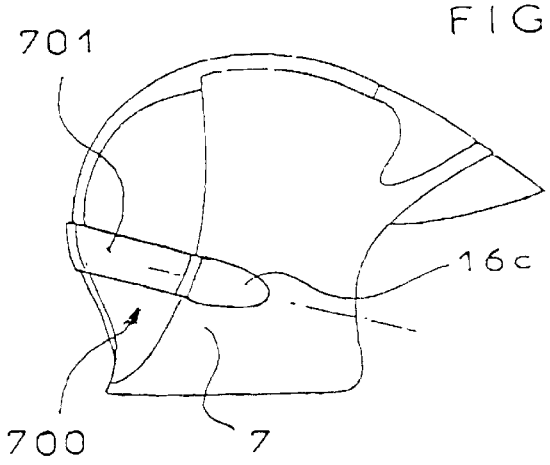

FIGS. 14 and 15 are views depicting a variant embodiment according to which the attachment parts 16*a*, 16*b* are connected to an intermediate part 700 affixed to the helmet. In this embodiment, the intermediate part resembles a stirrup open toward the front formed from a strip 701 of a flexible, elastic, or rigid material passing around the rear of the shell of the helmet 1 to be affixed thereto by any method. It should be noted that the front ends of the strip 701 comprise devices adapted to adjustably hold the two attachment parts 16*a*, 16*b*, with these devices being, for example, identical to those previously described 22, 19, 21.

The invention is not limited to the specific embodiments described and depicted by way of examples, but also comprises all technical equivalents, as well as combinations thereof.

What is claimed is:

1. A protective helmet comprising:

a shell for at least partially covering a user's head; and at least one device for attaching a respiratory mask to the shell, the at least one device being adjustably fixed to the shell;

whereby the at least one device is fixable in at least two positions, at least one of the at least two positions being a rear position and at least another of the at least two positions being a front position.

2. The helmet of claim 1, wherein the at least one device comprises a one piece structure.

3. The helmet of claim 2, wherein the shell comprises two side walls adapted to substantially cover the ears of a user.

4. The helmet of claim 3, wherein the at least one device comprises two devices, such that each of the side walls comprises the device adjustably fixed thereto.

5. The helmet of claim 1, wherein the at least one device is adjustably fixable to the shell in a plurality of positions, whereby the adjustment is determined by the user, and whereby at least one of the plurality of positions includes an intermediate position which is between the rear position and the front position.

6. The helmet of claim 1, wherein the at least one device is securable against further adjustment.

7. The helmet of claim 1, further comprising a locking mechanism for fixing the at least one device to the shell in a selected position.

8. The helmet of claim 1, wherein the front position is defined by a position which is arranged downward and frontward from the rear position, whereby movement from the rear position to the front position defines a trajectory which slopes downward and frontward.

9. The helmet of claim 8, wherein the trajectory is adapted to be in substantial alignment with lateral arms of the respiratory mask.

10. A protective helmet comprising:

a shell for at least partially covering a user's head; and at least one device for attaching a respiratory mask to the shell, the at least one device being adjustably fixed to the shell;

whereby the at least one device is fixable in at least two positions, wherein the at least one device is adjustably fixable to the shell in a plurality of positions, whereby the adjustment is determined by the user, and wherein the at least one device comprises one of a plurality of protrusions and a plurality of recessed sections which are integrally formed therewith, and wherein the shell comprises one of a plurality of cooperating protrusions and a plurality of cooperating recessed sections.

11. A protective helmet comprising:

a shell for at least partially covering a user's head; and at least one device for attaching a respiratory mask to the shell, the at least one device being adjustably fixed to the shell;

whereby the at least one device is fixable in at least two positions, and wherein the at least one device comprises one of an attachment notch and an attachment protrusion which is integrally formed therewith.

12. A protective helmet comprising:

a shell for at least partially covering a user's head; and at least one device for attaching a respiratory mask to the shell, the at least one device being adjustably fixed to the shell;

whereby the at least one device is fixable in at least two positions, and wherein the shell comprises one of an attachment notch and an attachment protrusion which is integrally formed therewith.

13. A protective helmet comprising:

a shell for at least partially covering a user's head; and at least one device for attaching a respiratory mask to the shell, the at least one device being adjustably fixed to the shell;

whereby the at least one device is fixable in at least two positions, and further comprising at least one intermediate part disposed between the shell and the at least one device.

14. A protective helmet comprising:

a shell for at least partially covering a user's head; and at least one device for attaching a respiratory mask to the shell, the at least one device being adjustably fixed to the shell;

whereby the at least one device is fixable in at least two positions;

the helmet further comprising at least one intermediate part disposed between the shell and the at least one device, wherein the intermediate part comprises an open stirrup configuration.

15. A protective helmet comprising:

a shell for at least partially covering a user's head; and at least one device for attaching a respiratory mask to the shell, the at least one device being adjustably fixed to the shell;

wherein the at least one device is fixable in at least two positions on the shell via a plurality of projections and a plurality of corresponding recess sections.

16. A protective helmet comprising:

a shell for at least partially covering a user's head having a first side and a second side, each of said first side and said second side being adapted to at least partially cover an ear of a user;

a device adjustably fixed to each of said first and said second sides for attaching a respiratory mask to the shell, whereby the mask comprises first and second lateral attachment arms;

the device further comprising a mechanism for retaining a lateral attachment arm;

wherein the device is adjustably fixable in at least two positions on the shell via a plurality of projections and a plurality of corresponding recess sections.

17. The helmet of claim 16, wherein the device comprises a plurality of recesses and the shell comprises a plurality of engagement projections.

18. The helmet of claim 16, further comprising an intermediate structure disposed between the device and the shell.

19. The helmet of claim 16, wherein the device comprises a plurality of projections and the shell comprises a plurality of engagement recesses.

20. The helmet of claim 19, wherein the device comprises a plurality of elongated projections and the shell comprises a plurality of slot shaped engagement recesses.

21. The helmet of claim 20, wherein the device further comprises a plurality of pin shaped projections and the shell further comprises a plurality of cylindrically shaped engagement recesses.

22. The helmet of claim 20, wherein the plurality of elongated projections comprise a triangular shape.

23. The helmet of claim 22, further comprising a locking mechanism for preventing further adjustment of the device on the shell.

24. The helmet of claim 16, further comprising a locking mechanism for preventing further adjustment of the device on the shell.

25. The helmet of claim 24, wherein the locking mechanism comprises a pin which engages an hole in the device and a hole in the shell.

26. The helmet of claim 25, wherein the device and the shell each comprise an integral structure.

27. The helmet of claim 16, wherein the mechanism comprises an attachment notch for retaining an attachment hook disposed on the lateral attachment arm of the mask.

28. The helmet of claim 16, wherein the mechanism comprises an attachment notch for retaining an attachment projection disposed on the lateral attachment arm of the mask.

29. The helmet of claim 16, wherein the mechanism comprises an attachment protrusion for retaining an attachment hole disposed on the lateral attachment arm of the mask.

30. The helmet of claim 16, wherein the device is disposed on an exterior surface of the shell.

31. The helmet of claim 16, further comprising an intermediate part having a stirrup shaped configuration disposed between the device and the shell.

32. The helmet of claim 31, wherein the intermediate part comprises one of a plurality of protrusions and engagement recesses for engaging the device and the shell.

33. The helmet of claim 32, wherein the intermediate part comprises an integrally formed structure.

* * * * *